United States Patent [19]

Cogswell et al.

[11] Patent Number: 4,466,319

[45] Date of Patent: Aug. 21, 1984

[54] ROTARY CUTTING SYSTEM FOR A PRINTING PRESS

[75] Inventors: John Cogswell, Needham; Robert F. Fokos, Wayland, both of Mass.

[73] Assignee: Special Products Engineering Corporation, Needham, Mass.

[21] Appl. No.: 335,505

[22] Filed: Dec. 29, 1981

[51] Int. Cl.[3] ..... B26D 1/56; B26D 7/18

[52] U.S. Cl. ..... 83/116; 83/117; 83/347

[58] Field of Search ..... 83/113, 116, 117, 154, 83/343, 346, 347

[56] References Cited

U.S. PATENT DOCUMENTS

| | | | |
|---|---|---|---|
| 909,957 | 1/1909 | Staude | 83/116 |
| 1,784,487 | 12/1930 | Feeney | 83/116 |
| 2,095,631 | 10/1937 | Cumfer . | |
| 2,546,069 | 3/1951 | Hart | 83/116 |
| 3,277,756 | 10/1966 | Des Jardins et al. | 83/116 |
| 3,857,314 | 12/1974 | Gregoire | 83/346 |
| 3,893,359 | 7/1975 | Gregoire | 83/154 |
| 4,073,485 | 2/1978 | Gregoire et al. | 270/21 |
| 4,099,626 | 7/1978 | Magnussen et al. | 211/194 X |
| 4,143,568 | 3/1979 | Cogswell | 83/116 |
| 4,224,851 | 9/1980 | Imai | 83/113 X |
| 4,240,313 | 12/1980 | Gillespie | 83/343 |

*Primary Examiner*—Donald R. Schran
*Attorney, Agent, or Firm*—Kenway & Jenney

[57] ABSTRACT

A rotary cutter for a printing press directs a web between a knife cylinder and an opposed anvil cylinder. The outer surface of the knife cylinder mounts one or more knife blade assemblies each having a sandwich construction. Each assembly includes at least one and usually two blades separated by a spacer bar. The assembly also includes a perforator blade and an ejector bar located on opposite sides of the spacer bar and set in recesses formed on the sides of the spacer bar. The perforator blade has laterally spaced sets of chisel-like teeth that impale trim pieces cut by the blades. The ejector bar reciprocates radially within the assembly to remove the trim piece from the teeth. The assembly is held together by two sets of bolts that allow the location of the blades to be set independently. A set of half rings each carrying radially projecting locating dowels are nested in circumferential grooves formed in the knife cylinder. Each ring is aligned against locating pins mounted in the knife cylinder. The knife assembly preferably includes a convex alignment surface that abuts an associated dowel in a point-to-point contact to locate the blade assembly on the knife cylinder accurately and easily.

12 Claims, 10 Drawing Figures

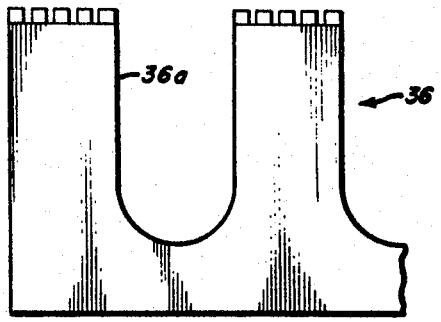
FIG. 5
FIG. 6
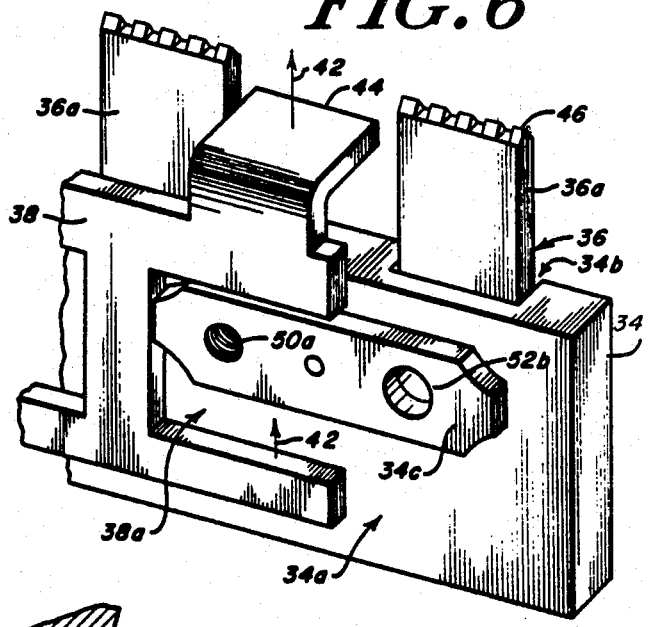
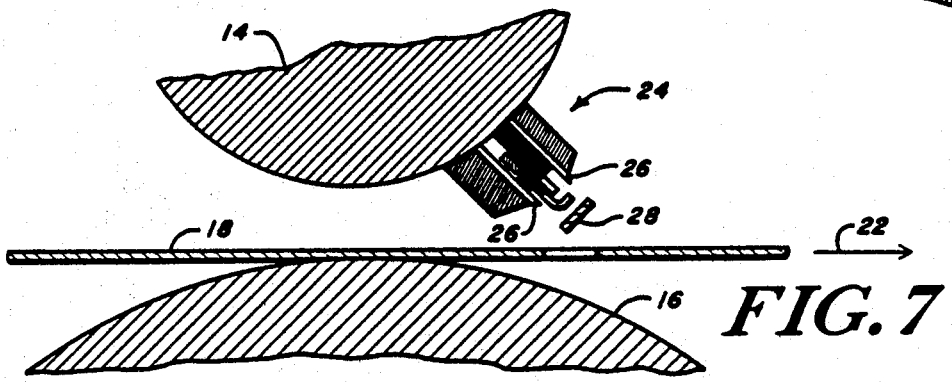
FIG. 7
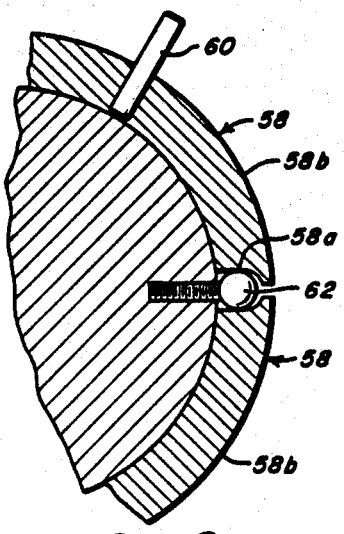
FIG. 9
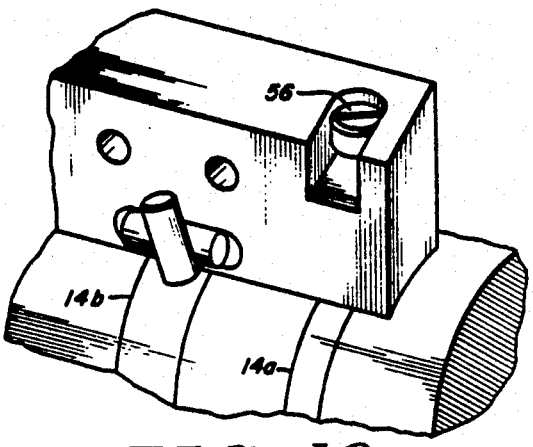
FIG. 10

ROTARY CUTTING SYSTEM FOR A PRINTING PRESS

BACKGROUND OF THE INVENTION

This invention relates in general to rotary cutters for printing presses. More specifically it relates to a rotary cutter that reliably removes trim pieces at a high speed and provides an extremely accurate and simple system for adjusting the location of the cutting blades, both radially and circumferentially.

In rotary printing presses used to manufacture booklets, magazines, labels and a wide variety of other products, a web of paper travels at a high speed through a series of stations that each perform an operation such as printing, perforating, folding or cutting the web. The cutting operations are typically carried out by an opposed pair of cylinders. One cylinder carries one or more knife blades to repeatedly cut the web at some regular spacing along the web as the cylinder rotates. The other cylinder can be solid or segmented, that is, with abutment surfaces for the knife blade or blades carried as assemblies on a core cylinder.

A particularly important application is a double "bleed" cutter where a pair of closely spaced blades cut the web to produce a narrow trim piece. It is important to remove the trim piece from the cutting area, carry it to a collection point away from the cutting zone, and remove it from the cutter at the collection point. The trim control must be reliable, even at high speeds, to prevent stray trim pieces from jamming or otherwise interfering with the product delivery process.

Over the years a number of systems have been developed to produce a rotary cut while at the same time controlling the movement of trim pieces. U.S. Pat. No. 3,857,314 and U.S. Pat. No. 4,073,485 assigned to Gregg Engineering Corp. describe a system for cutting and performing other operations. The '314 patent describes a rotary cutter where a knife is carried in a holder which in turn is mounted on the outer cylindrical surface of a roller.

Trim control in the Gregg System is accomplished by a set of pins mounted on an anvil roller opposed to the roller carrying the knife or knives. The trim pieces are speared on the ends of the pins as they are cut. Rotation of the anvil roller carries them to a stationary comb that strips the trim pieces off the pins. This general system is described in U.S. Pat. No. 3,893,359. U.S. Pat. Nos. 909,957, 1,784,487, 2,095,631 and 4,224,821 describe other mechanical ejection systems for use with rotary cutters.

These trim control systems have many serious problems. First, in any system using pins to impale the trim pieces the pins must extend through the trim piece into a mating hole or recess in order to securely grip the trim. This arrangement means that the abutting cylinder cannot be a smooth, solid surface. In the '359 patent, for example, the pins are located on the anvil cylinder to use the space between the knife blades and the core cylinder as this vertical recess. This arrangement results in a more complex assembly and one which has a significantly longer "set up" time than other systems. This is because in setting the knife blades and pins for a given production run, the operator must locate very accurately and secure both the knife blades and the pin assemblies. This set up involves both circumferential and radial adjustments in position. Another problem with any pin system is destruction of the pins when there is a paper jam. This requires that the entire printing operation be shut down while the pins are replaced. Still another problem with the Gregg system is that the comb that removes trim pieces must act against and be flush with a solid surface underneath the trim piece. In practice, it has proven difficult to remove trim reliably at high speeds using this "scraping" action.

Another more recent cutter and trim control arrangement is described in U.S. Pat. No. 4,143,568 assigned to Butler Automatic, Inc. This system focuses on a solution to a serious defect in the Gregg, Uniweb and other known systems, namely, the vibrations set up in the machine by a solid knife blade rapidly and repeatedly impacting against an anvil surface. A major disadvantage of these vibrations is that they alter the spacing between the knife blades and their associated anvil surfaces resulting in an inferior cut. The Butler solution is to spring mount the knife blades. Trim pieces (the "bleed cut") are impaled on a set of pins held in an elongated "strap" secured between the knife blades. A bar with angled over edge portions reciprocates in coordination with the rotation of the cutter to eject the trim from the pins at a point removed from the cut. As in the Gregg system, since the cylinder size is fixed by the size of the rotary printing press, variations in the length of the cut are made by changing the circumferential location of the knife blade assemblies and opposing anvil surfaces. While locating the pins between the blades provides enhanced protection, the pins nevertheless are subject to destruction during paper jams, they require an opposing hole or recess, and they must be set and adjusted to the proper height to avoid impacting a solid surface while impaling a trim piece to a sufficient depth to hold it securely.

All of the aforementioned systems attempt to meet a variety of important design objectives such as producing a clean cut at high speed, varying the location of the cut, controlling machine vibrations, avoiding blade wear, and reliably removing, transporting and then ejecting trim pieces produced by bleed cuts. The cut location is meticulously set at the beginning of each production run. A major disadvantage of the known systems is that setting the blade height and circumferential location are time consuming tasks that require a high degree of skill. Another significant problem is that after operation, frictional heat generated by the bearing causes expansion of components of the cutter which usually requires a shutdown and re-setting. Each setting and re-setting can last for a portion of an hour to several hours. This lost production time seriously limits the production capability of the entire printing press. Another problem encountered with the solid, fixed mount blades is that after an extended shutdown, during the night, for example, the blades' settings established during operation must be reset. Operation without re-setting results in the blades pounding the anvil surfaces which rapidly dulls the knife blades and sets up severe vibrations in the cutter. A particular problem with double knife blade assemblies for bleed cuts is that adjustments in the height setting of one blade can alter the setting of the other blade. Heretofore, no known rotary cutting system has reliably met all of these design objectives.

It is therefore a principal object of the present invention to provide a rotary cutting system for a printer that makes high quality cuts and reliably controls the retention and ejection of trim pieces at a high speed.

Another object is to provide a cutting system with the foregoing advantages that utilizes a single assembly acting in cooperation with a solid anvil cylinder to achieve both the cutting and the trim control operations.

Another object is to provide a cutting system that is easily, accurately and reliably adjusted with respect to both the height and the circumferential location of the knife blades.

A further object is to provide a cutting system that is characterized by a low vibration level and low level of knife blade wear.

A still further object of this invention is to control the trim pieces without the use of pins or complicated mechanical arrangements.

Yet another object of this invention is to provide a cutting system that provides a wide selection of types and locations of cuts while at the same time having a high degree of commonality of parts for the differing cuts.

A still further object of the invention is to provide a cutting system that is rugged, reliable and utilizes component parts that are comparatively simple to machine.

SUMMARY OF THE INVENTION

A rotary cutting system particularly adapted for use in a rotary printing press mounts at least one knife blade assembly on the outer surface of a rotatable cylinder. The knife blade assembly includes at least one and usually two full length knife blades rigidly secured to a knife blade holder that extends axially along the knife cylinder. A spacer bar located between the blades sets the inter-blade spacing and controls the length of the bleed cut. The assembly is secured to the knife cylinder by bolts that thread into nuts captured in circumferential grooves formed in the cylinder.

A perforator blade secured in the assembly between one knife blade and nested in mating recesses formed in one side of the spacer bar impales trim pieces on sets of chisel-like teeth formed in one edge of the blade and mutually spaced from one another along its length. An ejector bar is received in and guided in a radial reciprocating motion by recesses formed in the opposite side of the spacer bar. A cam system drives the ejector bar in coordination with the rotation of the knife cylinder.

The knife blades are secured independently of one another. A preferred arrangement uses two sets of bolts of differing lengths, one threading into the spacer bar to secure one knife blade and the other threading into a clamp bar located on the opposite side of the sandwich-like knife blade assembly from the knife holder. The assembly preferably includes a concave registration surface such as a half dowel that is secured to the outer surface of the knife holder.

A circumferential registration system for the knife blade assemblies includes pairs of half rings with each pair held in a circumferential groove formed in the knife cylinder. Each half ring has end alignment surfaces that abut and register with locating pins, preferably ball-headed, fixed in the body of the cylinder. The side walls of the grooves locate the associated pair of rings axially. Each ring carries a radially projecting dowel that is an alignment surface for the concave registration surface secured to the knife assembly. The half rings are captured in the grooves by the overlying knife blade assemblies.

These and other features and objects of the present invention will be more fully understood from the following detailed description which should be read in light of the accompanying drawings.

BRIEF DESCRIPTION OF THE DRAWINGS

FIG. 5 is a detailed view in front elevation of a portion of the perforator blade according to this invention used in the knife blade assembly shown in FIGS. 1–4;

FIG. 6 is a detailed view in perspective of a portion of the spacer bar, perforator bar and ejector bar of the knife blade assembly shown in FIGS. 1–4;

FIG. 7 is a view corresponding to FIG. 3 showing the ejection bar in its fully raised position which removes the trim piece from the perforator bar;

FIG. 9 is a view in vertical section with portions broken away of the half ring alignment system shown in FIG. 8; and FIG. 10 is a view in perspective with portions broken away of the knife blade assembly of FIGS. 1–7 aligned with the half ring registration system shown in FIGS. 8 and 9.

DETAILED DESCRIPTION OF THE PREFERRED EMBODIMENTS

Figure 1:
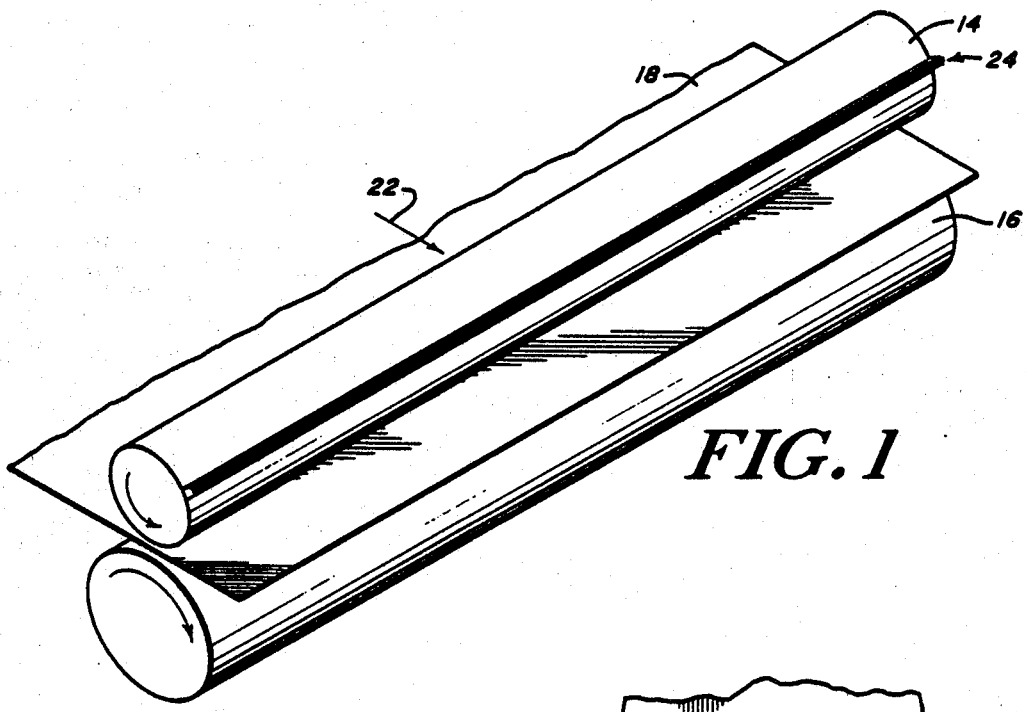
FIG. 1 is a highly simplified view in perspective of a rotary cutting system according to the present invention.

FIGS. 1–3 and 7 show a high speed rotary cutting system particularly adapted for use in printing presses. The system includes a rotatably mounted knife cylinder 14 and an opposed, solid anvil cylinder 16 which is also rotatably mounted. A web 18 of paper or other material moves through a contact point 20 between the cylinders 14 and 16 in the direction indicated by an arrow 22. The cylinders 14 and 16 rotate in coordination with the movement of the web 18.

One or more knife blade assemblies 24 are secured on the cylindrical outer surface of the cylinder 14. Each knife blade assembly 24 extends in a direction generally parallel to the axis of rotation of the cylinder 14 and includes one or more knife blades 26. The blades are oriented to execute a chop or butt cut transversely across the web 22 as it moves through the contact point 20. As is well known in the art, since the diameter of the knife cylinder for a given press is fixed, the length of the segments into which the web 22 is cut can be varied by changing the circumferential location of the knife blade assembly 24 or by using multiple knife blade assemblies and thereby introducing more than one cut in the web with each revolution of the knife cylinder. Often a pair of knife blades are mounted in close proximity to one another to produce a "bleed cut". This situation produces a trim piece 28 (FIG. 7) which must be removed from the printing press to prevent it from jamming or otherwise interfering with the printing operation.

The quality of the cuts made by the blade or blades 26 depends to a large degree on proper spacing from an opposed abutment surface. In the present invention, this surface is provided by a solid anvil cylinder 16. In known presses, particularly those using rigid knife blades, setting the spacing between the knife blades and the opposed abutment surface is a slow and meticulous procedure requiring a relatively high degree of skill. If the abutment surface is movable in the manner of the knife blades, this surface must also be properly "set".

Figure 3:
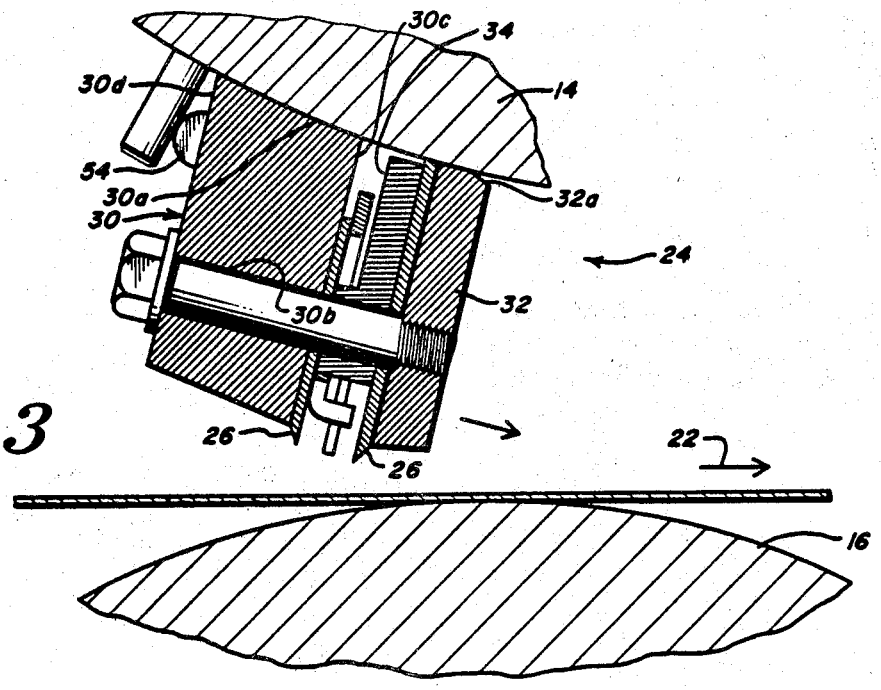
FIG. 3 is a detailed view in vertical section of the knife blade assemblies shown in FIGS. 1 and 2.

The principal feature of the present invention is the knife blade assembly 24 which includes an elongated knife blade holder 30, an opposed clamp bar 32, the knife blades 26, 26, and a spacer bar 34 which is interposed between the blades 26. (While many features of this invention are useful in single blade cutting systems, the double blade arrangement for a bleed cut is the most important. Therefore the following discussion describes this preferred double blade embodiment.) The assembly also includes a perforator bar 36 and an ejector bar 38 which nest in recesses **34*a* and 34*b* formed in opposite side faces of the spacer bar 34 as is best seen in FIG. 6. The perforator bar is secured to the spacer bar by a set of set screws 40 which thread into the spacer bar and hold the perforator bar in a fixed location with respect to the knife blade assembly. The ejector bar 38 includes a set of generally rectangular openings 38*a* that ride along associated projections 34*c* of the spacer bar 34. In particular, each projection 34*c* extends substantially the full width of the associated opening 38*a*, but has a clearance in the radial direction (with respect to the cylinder 14). This clearance allows a free upward and downward movement of the ejector bar with respect to the spacer bar 34 in the direction of an arrow 42 as shown in FIG. 6. The non-recessed side faces of the spacer bar each abut one of the blades 26. The width of the spacer bar, therefore sets the inter-blade spacing with a high degree of accuracy. As is best seen in FIG. 3, the recesses 34*b* are sufficiently deep so that the perforator bar 36 is generally centered between the blades 26, 26. In addition, the ejector bar has a series of angled over end portions 44 that are mutually spaced along the length of the ejector bar to intermesh with segments 36*a*** of the perforator bar.

Another significant feature of the present invention is the construction of the perforator bar. Each segment **36*a* has formed at its free end a set of chisel-like points 46. Each point 46 is sharpened and structured to impale and grip the trim piece 28. The perforator bar 36 with the sets of chisel points 36 formed at the ends of the sections 36*a* is a highly rugged structure which is not readily damaged if there is a paper jam. In addition, it has been found that the chisel points 46** will reliably retain the trim piece even during high speed operation.

Figure 4:
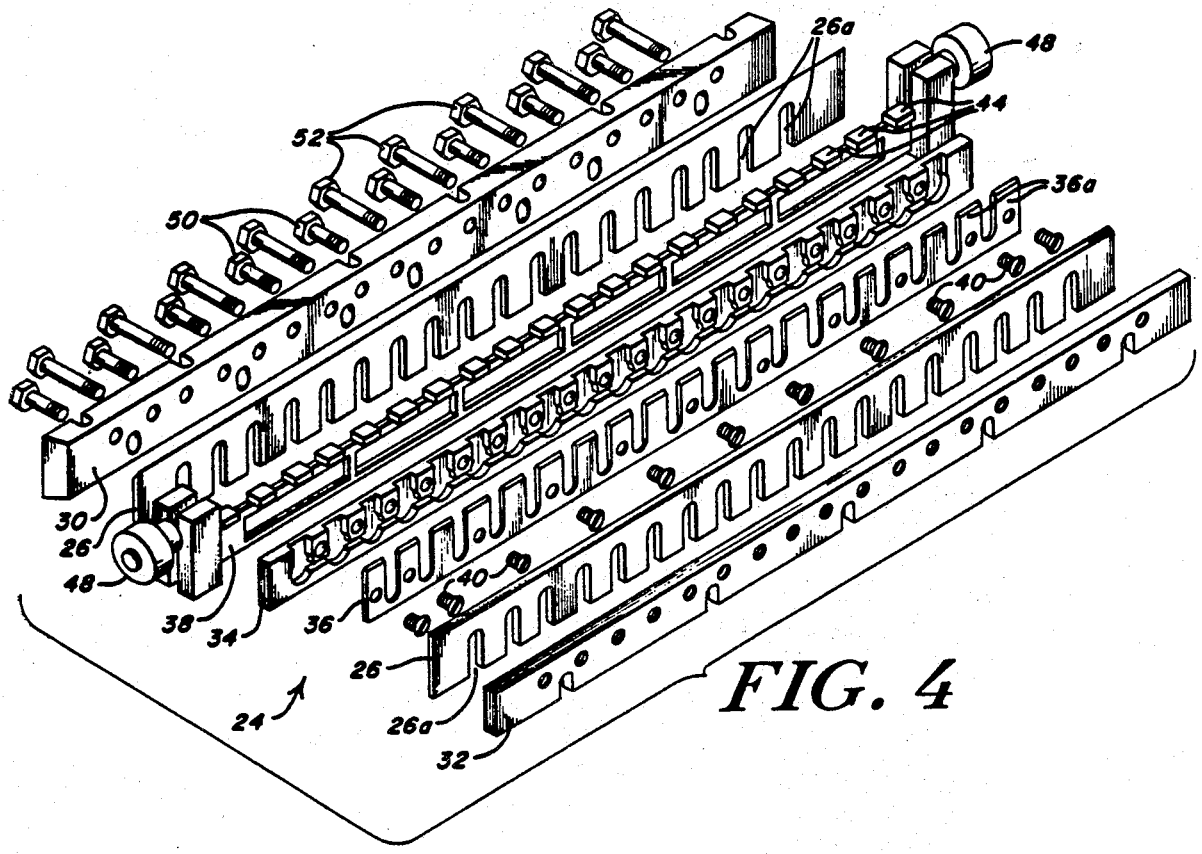
FIG. 4 is an exploded perspective view of the knife blade assembly shown in FIGS. 1–3.

Removal of the trim piece 28 from the perforator bar is accomplished by a movement of the ejector bar 38 from its normal lowered position shown in FIGS. 3 and 6 to a raised or ejecting position as shown in FIG. 7. This movement causes the angled over portions 44 of the ejector bar to push the trim piece 28 off the chisel points 46. The movement of the ejector bar is preferably controlled by a cam action developed by a set of ejector bar rollers 48, 48 which are mounted at the end of the ejector bar (FIG. 4) and it rides in a grooved path in the side frames of the rotary cutter (not shown). The path drives the rollers, and hence the ejector bar, from its lowered to its raised position at a preselected point during each rotation of the knife cylinder 14 to eject the trim piece at a preselected removal site. While this ejection is shown in FIG. 7 as occurring after a small rotation following the cut. In practice, however, removal will usually occur at a point farther from the cut site.

A significant advantage of the knife assembly 24 is that the height of the blades 26, 26 can be set independently of one another. This result is achieved by using two sets of bolts 50 and 52 of different lengths. The shorter bolts 50 are long enough to thread into threaded holes **50*a* formed in the spacer bar 34. Tightening the bolts 50 clamps the knife holder 30 against the spacer bar and thereby secures the interposed blade 26 at a fixed height. The bolts 52 thread directly into a threaded hole formed in the clamp bar 32. The bolts 52 pass freely through an aligned opening 52*b* formed in the spacer bar 34. As a result, tightening the bolts 50 and then the bolts 52 secures the position of the two blades 26 independently. It should be noted that each of the blades 26 has scalloped clearances 26*a* which allow the bolts 50 and 52 to pass freely through the blades. As shown, the bolts 50 and 52 are preferably alternated along the length of the assembly 24**.

The knife holder 30 has a curved bottom surface **30*a* that substantially conforms to the outer surface of the knife cylinder 14. In addition, the knife holder 30 preferably has a sufficient width to provide a stable base for the entire knife assembly once it is set on the knife cylinder 14. The knife holder includes a set of openings 30*b* which allow the bolts 50 and 52 to pass freely through the holder. The interior side face 30*c* of the holder is substantially flat and provides an alignment and support surface for the adjacent blade 26. The exterior side surface 30*d* of the holder carries a convex and axially oriented member 54, preferably a half-round metallic dowel which is welded or otherwise secured to the holder. The holder 30 also includes a series of vertical holes which accommodate a set of bolts 56 that each engage a nut (not shown) captured in a groove 14*a* formed in the knife cylinder 14. Threading the bolt 56 into the nut and tightening it secures the entire knife blade assembly in a preselected location on the exterior surface of the knife cylinder 14. The number of grooves 14*a* formed in the knife cylinder depends on the size of the printing press. There are typically four to seven grooves evenly spaced across the length of the cylinder. A typical diameter for the cylinder 14** is in the range of 7 to 16 inches.

The knife blade assembly 24 provides a high degree of flexibility in meeting different production needs through a simple substitution of components of the assembly. More specifically, the assembly 34 can use spacer bars 34 of different widths to establish different spacings between the blades 26, 26. Also, one of the knife blades 26 can be eliminated to provide a single cut as opposed to a bleed cut. To provide a tight clamping action while at the same time accommodating variations in the thickness of the components sandwiched between the holder 30 and the clamp bar 32, the lower edge **32*a* of the clamp bar is preferably rounded convexly. All of the components of the knife assembly 24 are preferably formed of hardened steel. Clearly, however, it is not necessary that all of the components be formed of the same material. For example, the knife blades and the perforator blade which have sharpened edges may be formed from a higher quality, hardened material which holds a sharpened edge better than materials which are used to form the elements 30, 32, and 34**.

In use, to set the height of the blades 26, 26 the knife blade assembly can be slowly rotated to a position where the blade located between the holder 32 and the spacer bar 34 is in contact with the anvil cylinder 16 along its length. A zero clearance setting is established and then secured by tightening the bolts 50 to a high torque level. Further rotation of the cylinder 14 brings the other blade 26 into contact with the anvil cylinder 16 along its length. A second zero clearance setting for this blade is established and then set by tightening the bolts 52 to a high torque level. The perforator bar is preferably set with a slight clearance between the chisel tips 46 and the solid anvil cylinder. This clearance is sufficient to impale the trim pieces securely while avoiding an impact of the chisel points 46 on the anvil cylinder 16.

Figure 8:
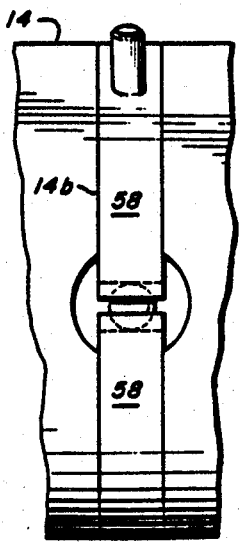
FIG. 8 is a view in the side elevation of a portion of the knife cylinder shown in FIGS. 1–3 and a pair of half rings used to align the knife blade assembly on the outer surface of the knife cylinder.

FIGS. 8, 9 and 10 illustrate a registration system for locating the knife blade assemblies 24 on the outer surface of the knife cylinder 14 at a preselected and accurately known circumferential location. The system features pairs of half rings 58, 58 that are each received in a single circumferential groove **14*b* formed in the outer surface of the knife cylinder 14. The half rings of each pair are substantially identical except that the location of radially projecting dowel pins 60 may vary. Each half ring is located and secured against axial movement by the closely fitting side walls of the associated groove 14*b*. The rings are accurately located circumferentially by ball headed pins 62 located at diametrically opposed positions in the groove 14*b* and secured to the body of the knife cylinder 14. A ball headed pin is preferred since it establishes a point contact with the generally flat end surface 58*a* of each of the half rings. The half rings are held in the grooves 14*b* by the overlying knife assemblies 24 which are bolted to the knife cylinders as described above. When the half rings are fully seated in the grooves, the two end surfaces 58*a* of each half ring abut in the aforementioned point contact the ball head of one of the pins 62. In addition, the bottom surface of each half ring 58 abuts the bottom wall of the groove 14*b* which is cut to a depth such that the outer surface 58*b* of the half rings 58 is substantially flush with the outer surface of the knife cylinder 14**.

Figure 2:
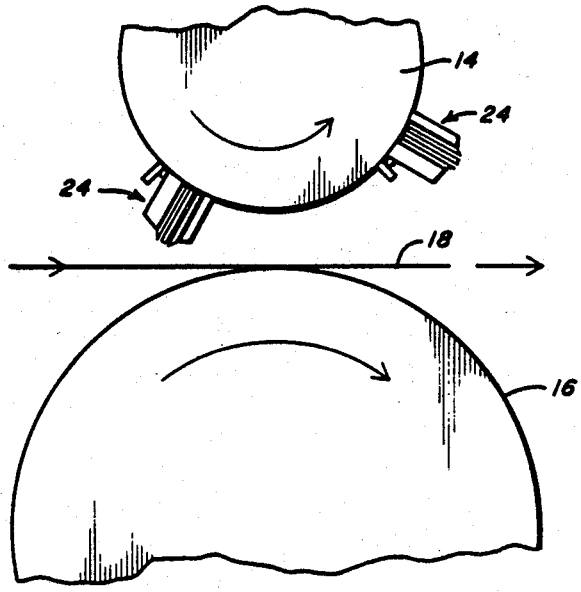
FIG. 2 is a more detailed view in side elevation of the cutting system shown in FIG. 1 with a second knife blade assembly mounted on the knife cylinder.

Insertion of a given set of half rings 58, 58 in each of the grooves **14*b* provides a set of extremely accurately aligned dowels 60 extending axially along one or more lines at the outer surface of the knife cylinder 14. Each of these lines of dowels 60 provides a registration surface for an associated knife assembly 24 as shown in FIGS. 2, 3 and 10. In particular, to locate an assembly 34 on the cylinder 14 with a high degree of accuracy it is only necessary to place the half round dowel 54 secured to the knife holder 30 in contact with an associated one of the dowels 60**. This dowel-to-dowel contact establishes a point-to-point contact that is extremely accurate.

To relocate the knife assembly or to provide a different number of knife assemblies on the knife cylinder, it is only necessary to remove the knife assemblies, remove the half rings 58, 58, which readily slide out of the grooves **14*b*, and insert a new set of half rings with appropriately positioned dowels 60. With these new half rings in place, one or more knife assemblies 24** are aligned against the dowels and are bolted into place as described above. This registration system allows a high degree of flexibility to meet varying production requirements while demanding only an extremely low level of skill. Further, the registration system can be produced using relatively simple machining operations. It is also quite important that the knife assembly itself can be fabricated using only standard machining operations. Manufacturing costs are also reduced through the use of a solid anvil cylinder as opposed to a segmented cylinder.

The rotary cutting system of the present invention provides a dramatic decrease in the set up time while at the same time producing a high quality cut at a high speed. The system also avoids the problems heretofore associated with pin-type trim retention systems while being extremely reliable even at high speeds. The rotary cutting system of the present invention is also characterized by a high degree of parts interchangeability and flexibility in meeting a wide range of production needs.

While the invention has been described with respect to its preferred embodiments, it will be understood that various modifications and alterations will occur to those skilled in the art from the foregoing description and drawings. One modification is utilizing a perforator bar that is formed by a set of separate elements each corresponding to one of the segments **36*a* and separately secured to the spacer bar. Another modification is mounting these discrete perforator segments in recesses formed in the projections 34*c*. With this latter modification, the ejector bar can be formed from bar stock without the angled over portions 44**. The perforator bar and the ejector bar in this embodiment are therefore located on the same side of the spacer bar. Such modifications and variations are intended to fall within the scope of the appended claims.

We claim:

1. A rotary cutting system that makes at least one cut across a moving web with each rotation of the system comprising:

a rotatable knife cylinder, a rotatable anvil cylinder, said knife cylinder and anvil cylinder together defining a nip that receives said moving web, at least one knife blade, a knife blade holder that locates and supports said knife blade, said holder being located on the outer surface of the knife cylinder, clamp means located on the opposite side of said blade from said blade holder, spacer means disposed between said blade and said clamp means, a perforator blade mounted with said spacer means and having laterally spaced apart sets of chisel-like teeth that project radially from said knife cylinder to impale a portion of said web adjacent said blade, ejector means mounted for a radially reciprocating movement within said spacer means between a retracted position which is clear of said teeth and a raised position that removes said web portion from said teeth, means for replaceably securing said knife blade, knife blade holder, spacer means, clamp means and perforator blade in a fixed, face-abutting, sandwich-like relationship, said securing means producing a gripping force oriented generally perpendicular to said abutting faces and said spacer means abutting said knife blade, and means for securing said assembly to said knife cylinder.

2. The rotary cutting system of claim 1 wherein said anvil cylinder is solid.

3. The rotary cutting system of claim 1 further comprising a second knife blade disposed between said spacer means and said clamp means, said spacer means setting the separation between said at least one blade and said second blade.

4. The rotary cutting system of claims 2 or 3 wherein said spacer means comprises an elongated member that has first recesses formed in one side face structured to receive said perforator blade and second recesses formed in an opposite side face structured to receive said ejector bar and including means for guiding said ejector bar along said radially reciprocating movement.

5. The rotary cutting system of claim 4 wherein said elongated spacer member has a plurality of thread means formed therein.

6. The rotary cutting system of claim 5 wherein said elongated spacer member includes a plurality of openings interspersed along said spacer member between said thread means.

7. The rotary cutting system of claim 6 wherein said means for replaceably securing includes a first set of bolts that engage said thread means to secure the radial location of said at least one knife blade.

8. The rotary cutting system of claim 7 wherein said means for replaceably securing includes a second set of bolts that extend freely through said openings and secure the location of said second knife blade.

9. The rotary cutting system of claim 8 wherein said blades are solid and extend generally the full length of the cylinder.

10. The rotary cutting system of claim 1 further comprising a convex registration surface extending parallel to the outer surface of said knife cylinder and projecting outwardly from said blade holder.

11. The rotary cutting system of claim 1 wherein said ejector bar includes a set of angled over end portions that are mutually spaced along the length of said bar and structured to engage and reliably remove said web from said teeth as said ejector bar moves to said raised position.

12. The rotary cutting system of claim 1 further comprising cam means for driving said ejector bar through said radially reciprocating movement in response to the rotation of said knife cylinder.

* * * * *